US005727779A

United States Patent [19]

Ramoski

[11] Patent Number: 5,727,779

[45] Date of Patent: Mar. 17, 1998

[54] CLAMPING STAND

[76] Inventor: Robert J. Ramoski, 6449 Tillery Rd., Lakeland, Fla. 33813

[21] Appl. No.: 775,729

[22] Filed: Dec. 31, 1996

[51] Int. Cl.[6] ..... B25B 1/16

[52] U.S. Cl. ..... 269/158; 269/902

[58] Field of Search ..... 269/157, 158, 269/159, 160, 162, 163, 259, 254 CS, 296, 902, 261, 262, 282, 283

[56] References Cited

U.S. PATENT DOCUMENTS

| | | | |
|---|---|---|---|
| 201,591 | 3/1878 | Breckenridge | 269/159 |
| 985,682 | 2/1911 | Landreth | 269/283 |
| 2,095,196 | 10/1937 | Paquette | 269/158 |
| 2,579,995 | 12/1951 | Atchison | 269/283 |
| 2,619,858 | 12/1952 | Starbuck et al. | 269/246 |
| 3,596,898 | 8/1971 | Hilburn | 269/243 |
| 3,632,101 | 1/1972 | Ross | 269/296 |
| 4,579,322 | 4/1986 | Schwarz | 269/246 |
| 4,848,960 | 7/1989 | Blankenship et al. | 269/254 CS |

FOREIGN PATENT DOCUMENTS

| | | | |
|---|---|---|---|
| 929271 | 6/1955 | Germany | 269/158 |

*Primary Examiner*—Robert C. Watson

[57] ABSTRACT

A new Clamping Stand for holding and clamping a workpiece in a fixed position so that work may be performed on the workpiece. The inventive device includes a vertical support member, a leg assembly extending downward from one end of the vertical support member, a workpiece tray provided at an opposite end of the vertical support member for holding a workpiece, and a clamping member movable relative to the workpiece tray for clamping the workpiece in the workpiece tray. A stirrup, adapted to receive a foot of a user of the stand, extends downward from the clamping member, whereby downward movement of the stirrup causes the clamping member to move downward against a workpiece positioned in the workpiece tray thereby clamping the workpiece in the workpiece tray.

21 Claims, 3 Drawing Sheets

FIG. 3
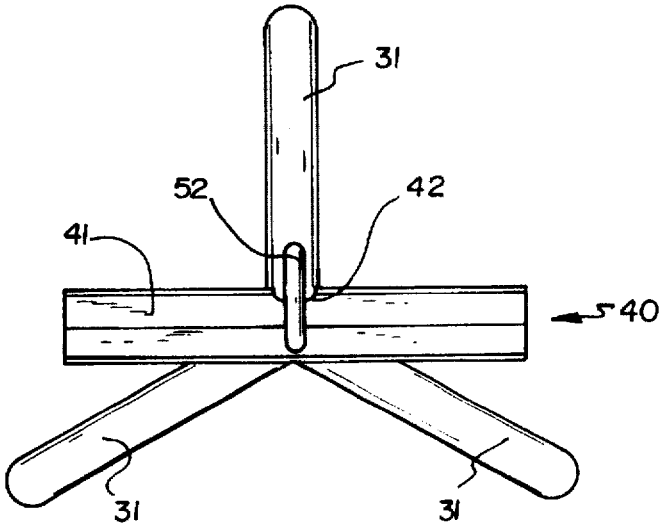
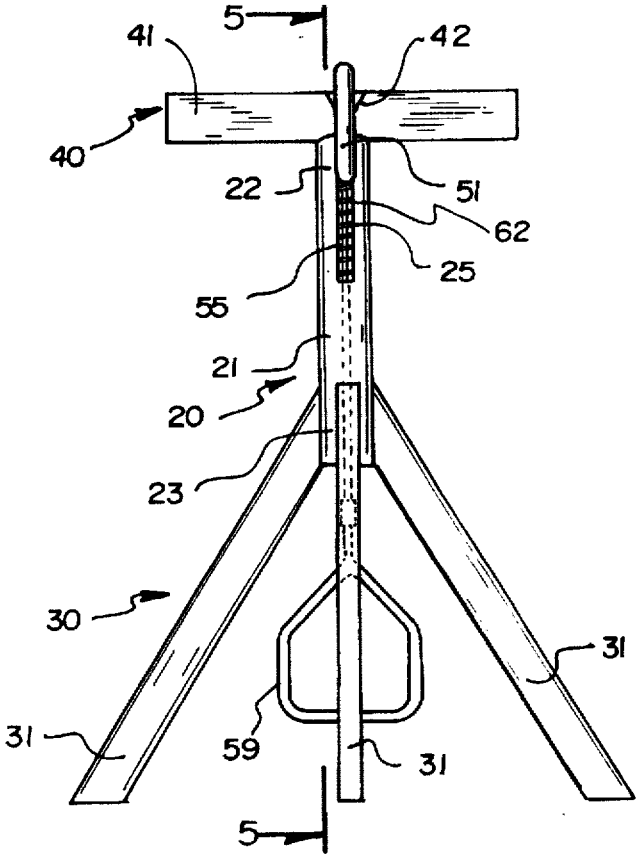
FIG. 4

CLAMPING STAND

BACKGROUND OF THE INVENTION

1. Field of the Invention

The present invention relates to clamping devices and more particularly pertains to a new Clamping Stand for holding and clamping a workpiece in a fixed position so that work may be performed on the workpiece.

2. Description of the Prior Art

The use of clamping devices is known in the prior art. More specifically, clamping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art clamping devices include U.S. Pat. No. 4,184,666; U.S. Pat. No. 5,351,944; U.S. Pat. No. D355,104; U.S. Pat. No. 4,874,156; U.S. Pat. No. 5,120,035 and U.S. Pat. No. 4,391,437.

While these devices fulfill their respective, particular objectives and requirements, the aforementioned patents do not disclose a new Clamping Stand. The inventive device includes a vertical support member, a leg assembly extending downward from one end of the vertical support member, a workpiece tray provided at an opposite end of the vertical support member for holding a workpiece, and a clamping member movable relative to the workpiece tray for clamping the workpiece in the workpiece tray. A stirrup, adapted to receive a foot of a user of the stand, extends downward from the clamping member, whereby downward movement of the stirrup causes the clamping member to move downward against a workpiece positioned in the workpiece tray thereby clamping the workpiece in the workpiece tray.

In these respects, the Clamping Stand according to the present invention substantially departs from the conventional concepts and designs of the prior art, and in so doing provides an apparatus primarily developed for the purpose of holding and clamping a workpiece in a fixed position so that work may be performed on the workpiece.

SUMMARY OF THE INVENTION

In view of the foregoing disadvantages inherent in the known types of clamping devices now present in the prior art, the present invention provides a new Clamping Stand construction wherein the same can be utilized for holding and clamping a workpiece in a fixed position so that work may be performed on the workpiece.

The general purpose of the present invention, which will be described subsequently in greater detail, is to provide a new Clamping Stand apparatus and method which has many of the advantages of the clamping devices mentioned heretofore and many novel features that result in a new Clamping Stand which is not anticipated, rendered obvious, suggested, or even implied by any of the prior art clamping devices, either alone or in any combination thereof.

To attain this, the present invention generally comprises a vertical support member, a leg assembly extending downward from one end of the vertical support member, a workpiece tray provided at an opposite end of the vertical support member for holding a workpiece, and a clamping member movable relative to the workpiece tray for clamping the workpiece in the workpiece tray. A stirrup, adapted to receive a foot of a user of the stand, extends downward from the clamping member, whereby downward movement of the stirrup causes the clamping member to move downward against a workpiece positioned in the workpiece tray thereby clamping the workpiece in the workpiece tray.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Clamping Stand apparatus and method which has many of the advantages of the clamping devices mentioned heretofore and many novel features that result in a new Clamping Stand which is not anticipated, rendered obvious, suggested, or even implied by any of the prior art clamping devices, either alone or in any combination thereof.

It is another object of the present invention to provide a new Clamping Stand which may be easily and efficiently manufactured and marketed.

It is a further object of the present invention to provide a new Clamping Stand which is of a durable and reliable construction.

An even further object of the present invention is to provide a new Clamping Stand which is susceptible of a low cost of manufacture with regard to both materials and labor, and which accordingly is then susceptible of low prices of sale to the consuming public, thereby making such Clamping Stand economically available to the buying public.

Still yet another object of the present invention is to provide a new Clamping Stand which provides in the apparatuses and methods of the prior art some of the advantages thereof, while simultaneously overcoming some of the disadvantages normally associated therewith.

Still another object of the present invention is to provide a new Clamping Stand for holding and clamping a workpiece in a fixed position so that work may be performed on the workpiece.

Yet another object of the present invention is to provide a new Clamping Stand which includes a vertical support member, a leg assembly extending downward from one end of the vertical support member, a workpiece tray provided at an opposite end of the vertical support member for holding a workpiece, and a clamping member movable relative to the workpiece tray for clamping the workpiece in the workpiece tray. A stirrup, adapted to receive a foot of a user of the stand, extends downward from the clamping member, whereby downward movement of the stirrup causes the clamping member to move downward against a workpiece positioned in the workpiece tray thereby clamping the workpiece in the workpiece tray.

Still yet another object of the present invention is to provide a new Clamping Stand that would allow a person to easily work on long items without the assistance of others.

Even still another object of the present invention is to provide a new Clamping Stand that would accommodate a variety of pipes, conduits, rods, boards, channels, etc.

Even still another object of the present invention is to provide a new Clamping Stand that would be easily transportable to a remote work site.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top view of the present invention.

FIG. 4 is a block view of the present invention.

DESCRIPTION OF THE PREFERRED EMBODIMENT

Figure 1:
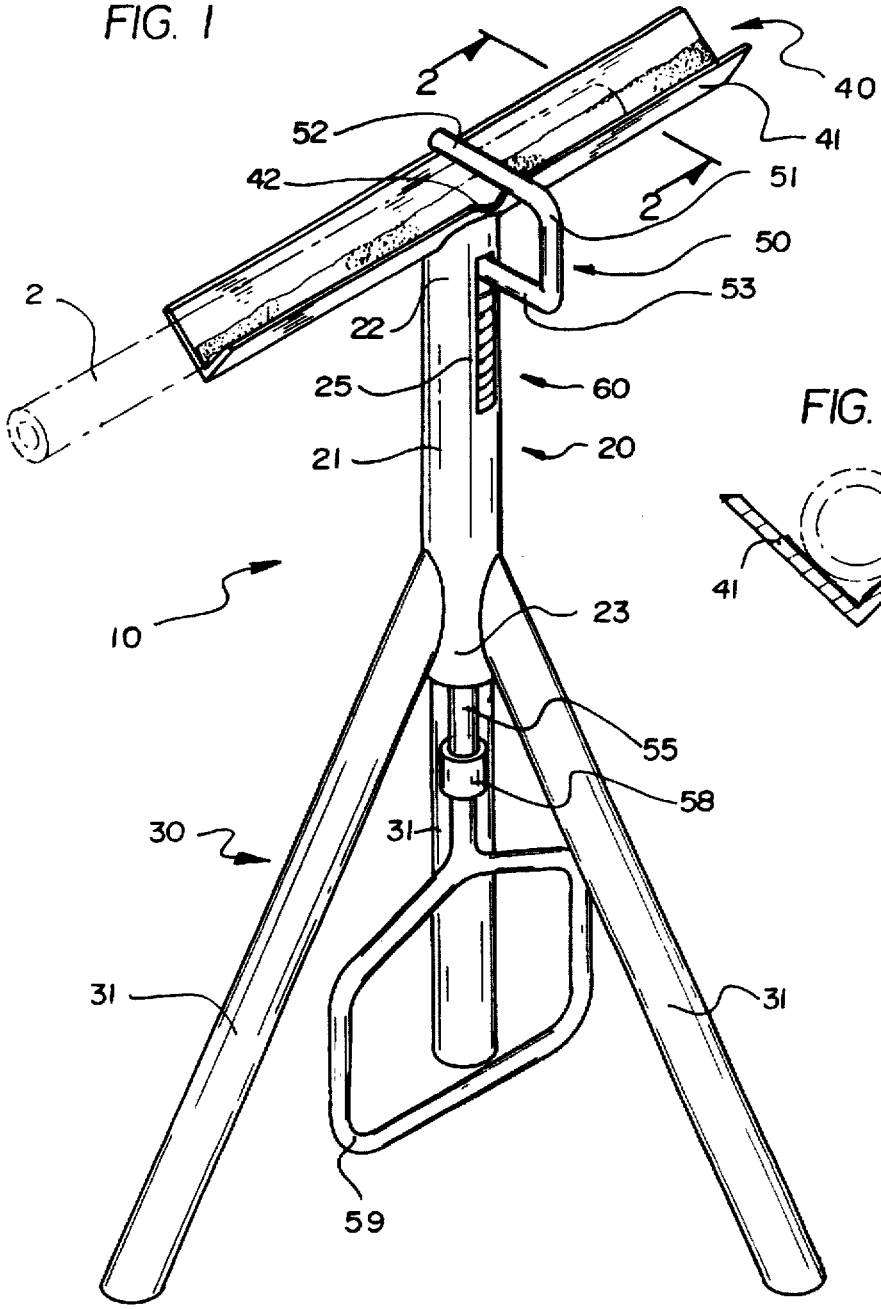
FIG. 1 is an illustration of a new Clamping Stand according to the present invention.

With reference now to the drawings, and in particular to FIGS. 1 through 6 thereof, a new Clamping Stand embodying the principles and concepts of the present invention and generally designated by the reference numeral 10 will be described.

More specifically, it will be noted that the Clamping Stand 10 comprises a vertical support member 20, a leg assembly 30 extending downward from one end of the vertical support member 20, a workpiece tray 40 provided at an opposite end of the vertical support member 20 for holding a workpiece 2, and a clamping member 50 movable relative to the workpiece tray 20 for clamping the workpiece 2 in the workpiece tray 40. A stirrup 59, adapted to receive a foot of a user of the stand 10, extends downward from the clamping member 50, whereby downward movement of the stirrup 59 causes the clamping member 50 to move downward against a workpiece 2 positioned in the workpiece tray 40 thereby clamping the workpiece 2 in the workpiece tray 40.

As best illustrated in FIGS. 1 and 4, it can be shown that the vertical support member 20 comprises a cylindrical sleeve 21 having a first end 22 and a second end 23. The cylindrical sleeve 21 has a vertical slot 25 therein adjacent the first end 22. As best illustrated in FIG. 5, it can be shown that a lip 26 is provided within the cylindrical sleeve 21 adjacent the second end 23.

As best illustrated in FIGS. 1 and 3, it can be shown that the leg assembly 30 is attached to and extends downward from the second end 23 of the cylindrical sleeve 21. The leg assembly 30 comprises three legs 31 each attached to the second end 23 of the cylindrical sleeve 21. The three legs 31 extend downward from the cylindrical sleeve 21 in a diverging relationship.

Figure 2:
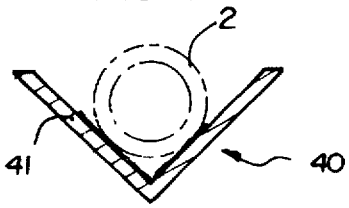
FIG. 2 is a cross sectional view taken along line 2–2 of FIG. 1.

As best illustrated in FIGS. 1 and 2, it can be shown that the workpiece tray 40 is attached to the first end 22 of the cylindrical sleeve 21. The workpiece tray 40 comprises a V-shaped channel 41 adapted to hold a variety of workpieces 2 in a generally horizontal position. The V-shaped channel 41 can accommodate pipes, conduits, rods, boards, and channels. A notch 42 is provided in the workpiece tray 40. The notch 41 is aligned with the clamping member 50 and allows for adequate downward movement of the clamping member 50 against the workpiece 2.

Figure 5:
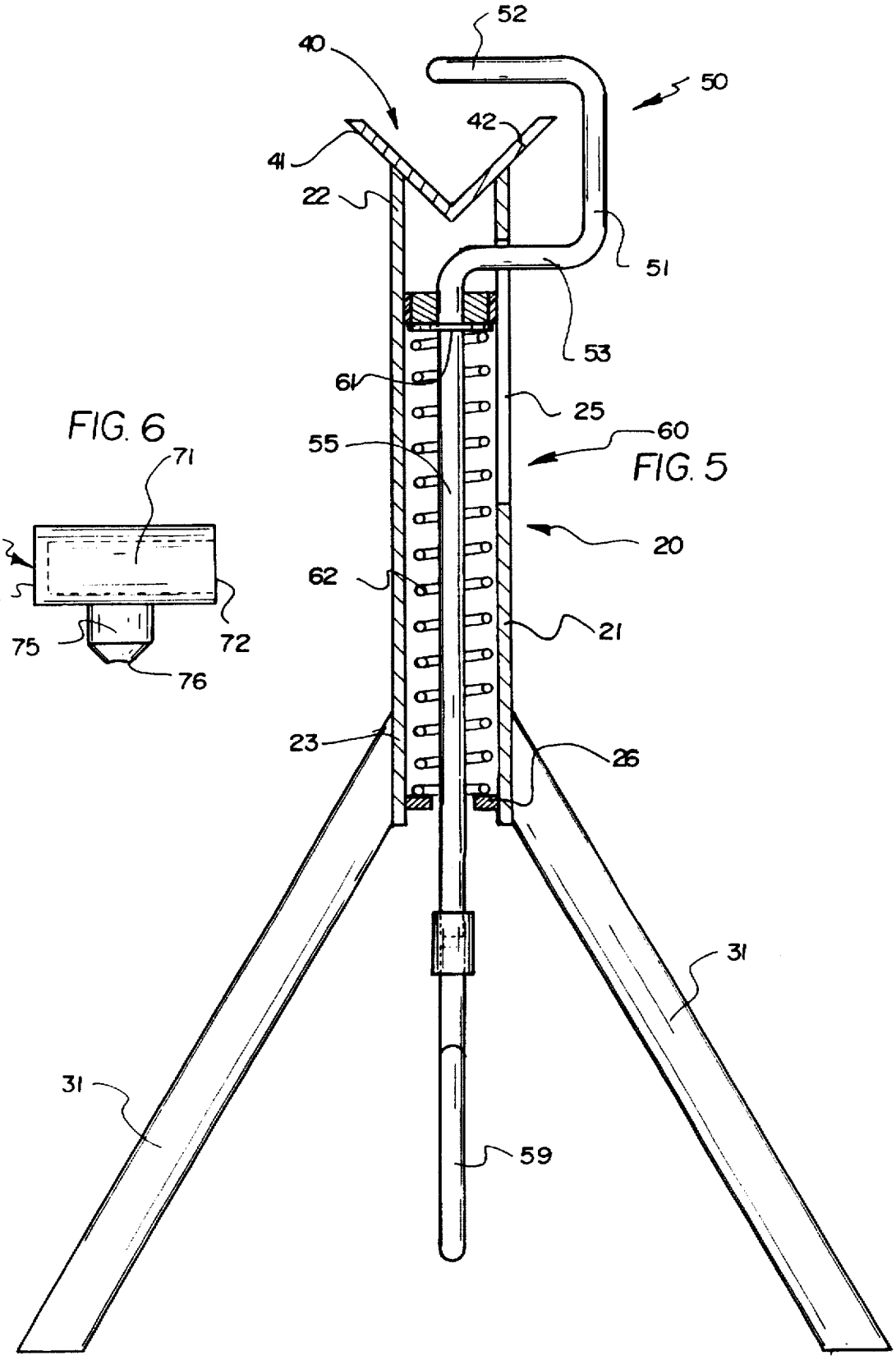
FIG. 5 is a cross-sectional view taken along line 5–5 of FIG. 4.

As best illustrated in FIG. 5, it can be shown that the clamping member 50 includes a clamping portion 51 and a shaft portion 55. The clamping portion 51 is generally C-shaped and includes an upper arm 52 and a lower arm 53. The upper arm 52 is substantially horizontal and positioned above the workpiece tray 40. The upper arm 52 provides a single contact against the workpiece 2. The notch 42 in the workpiece tray 40 allows the upper arm 52 of the clamping portion 51 to penetrate the workpiece tray 40 and clamp the workpiece 2 in the workpiece tray 40. The lower arm 53 of the clamping portion 51 fits within the vertical slot 25 provided in the cylindrical sleeve 21. The shaft portion 55 of the clamping member 50 is slidably mounted within the cylindrical sleeve 21.

As best illustrated in FIG. 1, it can be shown that the stirrup 59 is attached to and extends downward from the shaft portion 55 of the clamping member 50. A coupling 58 removably attaches the stirrup 59 to the shaft portion 55 of the clamping member 50. Downward movement of the stirrup 59 causes the clamping member 50 to move downward whereby the lower arm 53 of the clamping portion 51 travels downward within the vertical slot 25 provided in the cylindrical sleeve 21 and whereby the upper arm 52 of the clamping portion 51 moves downward and engages the workpiece 2 thereby holding and clamping the workpiece 2 in and against the workpiece tray 40.

As best illustrated in FIG. 5, it can be shown that a spring means 60 is provided for urging the upper arm 52 of the clamping portion 51 of the clamping member 50 above and away from the workpiece tray 40. The spring means 60 comprises a ring 61 slidably fitted within the cylindrical sleeve 21 and concentrically attached to the shaft portion 55 of the clamping member 50, and a spring 62 located within the cylindrical sleeve 21 and positioned around the shaft portion 55 of the clamping member 50, wherein the spring 62 is positioned between the ring 61 and the lip 26 provided within the cylindrical sleeve 21. Downward movement of the stirrup 59 compresses the spring 62 between the ring 61 and the lip 26.

Figure 6:
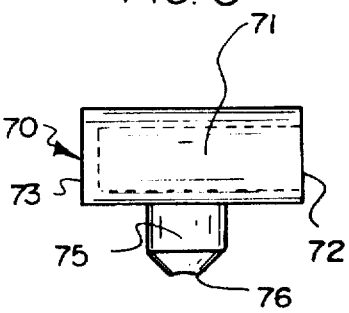
FIG. 6 is an illustration of a clamping member adapter for use with the present invention.

As best illustrated in FIG. 6, it can be shown that a clamping member adapter 70 is provided for use when working with a small workpiece 2. The clamping member adapter 70 is removably attached to the upper arm 52 of the clamping portion 51 of the clamping member 50. The clamping member adapter 70 comprises a sleeve member 71 which engages the upper arm 52 of the clamping portion 51 and a contact member 75 which projects perpendicularly from the sleeve member 71. The sleeve member 71 has an open end 72 and a closed end 73, wherein the open end 72 receives the upper arm 52 of the clamping portion 51. The contact member 75 has a concave-shaped contact end 76 which engages the small workpiece 2 thereby holding and clamping the small workpiece 2 in and against the workpiece tray 40.

In use, a user of the stand 10 places a workpiece 2 in the workpiece tray 40. The user inserts a foot in the stirrup 59 and steps down whereby the lower arm 53 of the clamping portion 51 travels downward within the vertical slot 25 provided in the cylindrical sleeve 21 and whereby the upper arm 52 of the clamping portion 51 moves downward and engages the workpiece 2 thereby holding and clamping the workpiece 2 in and against the workpiece tray 40. With the workpiece 2 held and clamped in the workpiece tray 40, the user can easily work on the workpiece 2. When finished working on the workpiece 2, the user removes his or her foot from the stirrup 59, whereby the spring means 60 urges the upper arm 52 of the clamping portion 51 of the clamping member 50 above and away from the workpiece tray 40 thereby allowing the user to remove the workpiece 2 from the workpiece tray 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for holding and clamping a workpiece, comprising:

a vertical support member having a vertical slot therein;

a leg assembly extending downward from one end of said vertical support member;

a workpiece tray provided at an opposite end of said vertical support member for holding said workpiece;

a clamping member movable relative to said workpiece tray for clamping said workpiece in said workpiece tray, said clamping member including a clamping portion and a shaft portion, said clamping portion including an upper arm and a lower arm, said upper arm positioned above said workpiece tray and adapted to engage said workpiece, said lower arm slidably fitting within said vertical slot in said vertical support member, said shaft portion slidably mounted within said vertical support member; and a stirrup adapted to receive a foot of a user of said apparatus, said stirrup extending downward from said clamping member whereby downward movement of said stirrup causes said clamping member to engage and clamp said workpiece in said workpiece tray.

2. The apparatus of claim 1, further comprising:

an urging means for urging said upper arm of said clamping portion of said clamping member above and away from said workpiece tray.

3. The apparatus of claim 1, wherein said leg assembly comprises:

three legs each attached to and extending downward from said vertical support member in a diverging relationship.

4. The apparatus of claim 1, wherein said workpiece tray has a notch therein, said notch being aligned with said clamping member and allowing said clamping member to penetrate said workpiece tray and clamp said workpiece in said workpiece tray.

5. The apparatus of claim 2, further comprising:

a lip provided within said vertical support member adjacent a lower end thereof, and wherein said urging means comprises:

a ring attached to said shaft portion of said clamping member and slidably fitted within said vertical support member, and a spring located within said vertical support member and disposed around said shaft portion of said clamping member, said spring positioned between said ring and said lip whereby said spring urges said upper arm of said clamping member above and away from said workpiece tray and whereby downward movement of said stirrup compresses said spring between said ring and said lip.

6. An apparatus for holding and clamping a workpiece, comprising:

a cylindrical sleeve having a first end and a second end, said cylindrical sleeve having a vertical slot therein adjacent said first end;

a leg assembly extending downward from said second end of said cylindrical sleeve;

a workpiece tray provided at said first end of said cylindrical sleeve for holding said workpiece;

a clamping member movable relative to said workpiece tray for clamping said workpiece in said workpiece tray, said clamping member including a clamping portion and a shaft portion, said clamping portion being generally C-shaped and including an upper arm and a lower arm, said upper arm being substantially horizontal and positioned above said workpiece tray, said upper arm adapted to engage said workpiece, said lower arm slidably fitting within said vertical slot in said cylindrical sleeve, said shaft portion slidably mounted within said cylindrical sleeve; and a stirrup adapted to receive a foot of a user of said apparatus, said stirrup extending downward from said clamping member whereby downward movement of said stirrup causes said clamping member to engage and clamp said workpiece in said workpiece tray.

7. The apparatus of claim 6, wherein said leg assembly comprises:

three legs each attached to said second end of said cylindrical sleeve, said three legs extending downward from said cylindrical sleeve in a diverging relationship.

8. The apparatus of claim 6, wherein said workpiece tray comprises:

a V-shaped channel adapted to hold said workpiece in a generally horizontal position.

9. The apparatus of claim 8, wherein said workpiece tray has a notch therein, said notch being aligned with said clamping member and allowing said clamping member to penetrate said workpiece tray and clamp said workpiece in said workpiece tray.

10. The apparatus of claim 6, wherein said upper arm of said clamping portion of said clamping member provides a single contact against said workpiece.

11. The apparatus of claim 6, wherein said stirrup is attached to and extends downward from said shaft portion of said clamping member whereby downward movement of said stirrup causes said lower arm of said clamping portion to travel downward within said vertical slot in said cylindrical sleeve and causes said upper arm of clamping member to move downward and engage said workpiece thereby holding and clamping said workpiece in and against said workpiece tray.

12. The apparatus of claim 6, further comprising:

a spring means for urging said upper arm of said clamping portion of said clamping member above and away from said workpiece tray.

13. The apparatus of claim 12, further comprising:

a lip provided within said cylindrical sleeve adjacent said second end, and wherein said spring means comprises:

a ring slidably fitted within said cylindrical sleeve and attached to said shaft portion of said clamping member, and a spring located within said cylindrical sleeve and positioned around said shaft portion of said clamping member, said spring positioned between said ring and said lip provided within said cylindrical sleeve, downward movement of said stirrup compressing said spring between said ring and said lip.

14. The apparatus of claim 6, further comprising:

a clamping member adapter removably attached to said clamping member for use in holding and clamping a small workpiece in said workpiece tray.

15. The apparatus of claim 14, wherein said clamping member adapter comprises:

a sleeve member having an open end, said open end engagingly receiving said clamping member, and a contact member perpendicularly projecting from said sleeve member, said contact member having a concave-shaped contact end for holding and clamping said small workpiece in and against said workpiece tray.

16. An apparatus for holding and clamping a workpiece, comprising:

a cylindrical sleeve having a first end and a second end, said cylindrical sleeve having a vertical slot therein adjacent said first end;

a leg assembly attached to and extending downward from said second end of said cylindrical sleeve;

a workpiece tray attached to said first end of said cylindrical sleeve for holding said workpiece in a generally horizontal position;

a clamping member movable relative to said workpiece tray for clamping said workpiece in said workpiece tray, said clamping member including a clamping portion and a shaft portion, said clamping portion being generally C-shaped and including an upper arm and a lower arm, said upper arm being substantially horizontal and positioned above said workpiece tray, said lower arm slidably fitting within said vertical slot in said cylindrical sleeve, said shaft portion slidably mounted within said cylindrical sleeve; and a stirrup adapted to receive a foot of a user of said apparatus, said stirrup attached to and extending downward from said shaft portion of said clamping member, downward movement of said stirrup causing said clamping member to move downward whereby said lower arm of said clamping portion travels downward within said vertical slot in said cylindrical sleeve and whereby said upper arm of said clamping portion moves downward thereby engaging and clamping said workpiece in said workpiece tray.

17. The apparatus of claim 16, wherein said leg assembly comprises:

three legs each attached to said second end of said cylindrical sleeve, said three legs extending downward from said cylindrical sleeve in a diverging relationship.

18. The apparatus of claim 16, wherein said workpiece tray comprises:

a V-shaped channel adapted to hold said workpiece, said V-shaped channel having a notch therein, said notch aligned with said clamping member and allowing said upper arm of said clamping portion to penetrate said workpiece tray and clamp said workpiece in said workpiece tray.

19. The apparatus of claim 16, further comprising:

a spring means for urging said upper arm of said clamping portion of said clamping member above and away from said workpiece tray.

20. The apparatus of claim 19, further comprising:

a lip provided within said cylindrical sleeve adjacent said second end, and wherein said spring means comprises a ring slidably fitted within said cylindrical sleeve and concentrically attached to said shaft portion of said clamping member, and a spring located within said cylindrical sleeve and positioned around said shaft portion of said clamping member, said spring positioned between said ring and said lip provided within said cylindrical sleeve, downward movement of said stirrup compressing said spring between said ring and said lip.

21. The apparatus of claim 16, further comprising:

a clamping member adapter removably attached to said upper arm of said clamping portion for use in holding and clamping a small workpiece in said workpiece tray, said clamping member adapter comprising a sleeve member having an open end, said open end engagingly receiving said upper arm of said clamping portion, and a contact member perpendicularly projecting from said sleeve member, said contact member having a concave-shaped contact end.

* * * * *